US007439692B2

(12) United States Patent
Lee

(10) Patent No.: US 7,439,692 B2
(45) Date of Patent: Oct. 21, 2008

(54) LINEAR COMPRESSOR AND APPARATUS TO CONTROL THE SAME

(75) Inventor: Kwang Woon Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1018 days.

(21) Appl. No.: 10/790,700

(22) Filed: Mar. 3, 2004

(65) Prior Publication Data

US 2005/0031470 A1 Feb. 10, 2005

(30) Foreign Application Priority Data

Aug. 4, 2003 (KR) ..... 10-2003-0053779

(51) Int. Cl.
*H02K 41/02* (2006.01)

(52) U.S. Cl. ..... 318/135; 21/127; 21/128; 21/133; 21/119; 21/14

(58) Field of Classification Search ..... 318/135, 318/119, 126, 128, 767, 807, 808, 809, 127, 318/133, 14, 21
See application file for complete search history.

(56) References Cited

U.S. PATENT DOCUMENTS 4,772,838 A * 9/1988 Maresca ..... 318/687
4,965,864 A * 10/1990 Roth et al. ..... 318/135
5,018,357 A * 5/1991 Livingstone et al. ..... 62/6
5,535,593 A * 7/1996 Wu et al. ..... 62/6
5,947,693 A 9/1999 Yang
5,955,799 A * 9/1999 Amaya et al. ..... 310/36
5,980,211 A * 11/1999 Tojo et al. ..... 417/45
6,501,240 B2 * 12/2002 Ueda et al. ..... 318/135
6,832,898 B2 * 12/2004 Yoshida et al. ..... 417/44.11
6,857,858 B2 * 2/2005 Jeun ..... 417/45
7,148,636 B2 * 12/2006 Ueda et al. ..... 318/114
7,245,101 B2 * 7/2007 Dadd ..... 318/561
2001/0005320 A1 * 6/2001 Ueda et al. ..... 363/95
2002/0113569 A1 * 8/2002 Iijima et al. ..... 318/727

(Continued)

FOREIGN PATENT DOCUMENTS

JP 10-288165 10/1998

(Continued)

OTHER PUBLICATIONS

Japanese Office Action dated, May 22, 2007 was issued in corresponding Japanese Patent Application No. 2004-085311.

(Continued)

*Primary Examiner*—Rita Leykin
(74) *Attorney, Agent, or Firm*—Staas & Halsey LLP

(57) ABSTRACT

A linear compressor and apparatus to control the linear compressor are provided which allows a frequency of a drive current supplied to a drive motor to synchronize with a resonance frequency varying according to a load fluctuation, in real time, thus obtaining a maximum efficiency of the linear compressor. The linear compressor includes a drive motor, a piston reciprocating by the drive motor and a control unit generating a reference current having a phase difference of 90° with respect to a displacement waveform of the piston and a frequency equal to the displacement waveform of the piston, and controls a drive current supplied to the drive motor to synchronize with a resonance frequency of the piston by synchronizing the drive current with the reference current.

15 Claims, 6 Drawing Sheets

U.S. PATENT DOCUMENTS

| | | | | |
|---|---|---|---|---|
| 2003/0108430 | A1* | 6/2003 | Yoshida et al. | 417/44.11 |
| 2003/0164691 | A1* | 9/2003 | Ueda et al. | 318/135 |
| 2004/0108824 | A1* | 6/2004 | Ueda et al. | 318/114 |
| 2004/0169480 | A1* | 9/2004 | Ueda et al. | 318/114 |

FOREIGN PATENT DOCUMENTS

| | | |
|---|---|---|
| JP | 11-351143 | 12/1999 |
| JP | 2002-354864 | 12/2002 |

OTHER PUBLICATIONS

Japanese Office Action dated, Jan. 16, 2007 was issued in corresponding Japanese Patent Application No. 2004-085311.
Chinese Office Action issued Nov. 17, 2006 in Chinese Patent Application No. 200410039728.1.

* cited by examiner

LINEAR COMPRESSOR AND APPARATUS TO CONTROL THE SAME

CROSS-REFERENCE TO RELATED APPLICATION

This application claims the benefit of Korean Patent Application No. 2003-53779, filed Aug. 4, 2003 in the Korean Intellectual Property Office, the disclosure of which is incorporated herein by reference.

BACKGROUND OF THE INVENTION

1. Field of the Invention

The present invention relates, in general, to linear compressors and, more particularly, to a linear compressor in which a piston is linearly reciprocated by a linear motor, and an apparatus to control the linear compressor.

2. Description of the Related Art

Generally, since a reciprocating compressor converts a rotary motion of a motor into a linear motion to operate a piston, an energy loss occurs during a motion conversion procedure, thus deteriorating an energy efficiency thereof. Different from that of the reciprocating compressor, a linear compressor uses a linear motor in which a mover linearly reciprocates, so that a linear motion of a piston is directly connected to the linear motion of the mover of the linear motor without a procedure to convert a rotary motion into the linear motion, thus reducing an energy loss therefrom. As a result, the linear compressor is more efficient than that of the reciprocating compressor.

In the linear compressor, a maximum efficiency may be obtained when a resonance frequency of the linear compressor and a frequency of a drive current supplied to the linear motor are equal. However, since the resonance frequency actually varies due to certain causes, such as a load fluctuation of a piston, a scheme is required to cause the frequency of the drive current to be equal to the resonance frequency of the linear compressor.

SUMMARY OF THE INVENTION

Accordingly, it is an aspect of the present invention to provide a linear compressor and apparatus to control the linear compressor, which allows a frequency of a drive current of the linear compressor supplied to a drive motor to be synchronized with a resonance frequency varying according to a load fluctuation, in real time, thus obtaining a maximum efficiency of the linear compressor.

Additional aspects and/or advantages of the invention will be set forth in part in the description which follows and, in part, will be obvious from the description, or may be learned by practice of the invention.

The above and/or other aspects are achieved by providing a linear compressor including a drive motor and a piston reciprocating by the drive motor. A control unit generates a reference current having a phase difference of 90° and an equal frequency with respect to a displacement waveform of the piston, and controls a drive current supplied to the drive motor to synchronize with a resonance frequency of the piston by synchronizing the drive current with the reference current.

The above and/or other aspects are achieved by providing an apparatus controlling a linear compressor including a displacement/speed detecting unit, an amplitude control unit, a phase control unit and a current control unit. The displacement/speed detecting unit generates at least one of a displacement waveform and a speed waveform of a piston. The amplitude control unit sets a maximum amplitude of a drive current required to control a drive motor so that top and bottom dead centers of the piston, respectively, satisfy top and bottom dead center commands received from an outside of the linear compressor. The phase control unit generates a reference waveform satisfying a condition in which the reference waveform has a phase difference of 90° and an equal frequency with respect to the displacement waveform of the piston, or a condition in which the reference waveform has both a phase and a frequency equal to those of the speed waveform of the piston.

The current control unit generates a reference current according to amplitude information and phase and frequency information provided from the amplitude control unit and the phase control unit, respectively, and controls the drive current supplied to the drive motor to synchronize with the reference current.

A driving force generated by the drive motor (linear motor) of the linear compressor is proportional to a product of a back electromotive force of the drive motor and the drive current supplied to the drive motor. Therefore, when a drive current with a phase equal to that of the back electromotive force is supplied to the drive motor, the linear compressor may be operated at the maximum efficiency. In a case in which the linear compressor is driven at a frequency (for example, 60 Hz or 50 Hz) equal to that of AC power by using a switching device, such as a triac, and a phase control scheme, a resonance frequency of the linear compressor and a frequency of the AC power are equal. Therefore, when a drive current with a phase equal to that of the back electromotive force of the drive motor is supplied to the motor, the linear compressor may be operated at the maximum efficiency. When the linear compressor is driven at the resonance frequency, the drive current has a phase equal to that of the back electromotive force (or the speed) of the motor and has a phase difference of 90° compared to the displacement of the piston.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
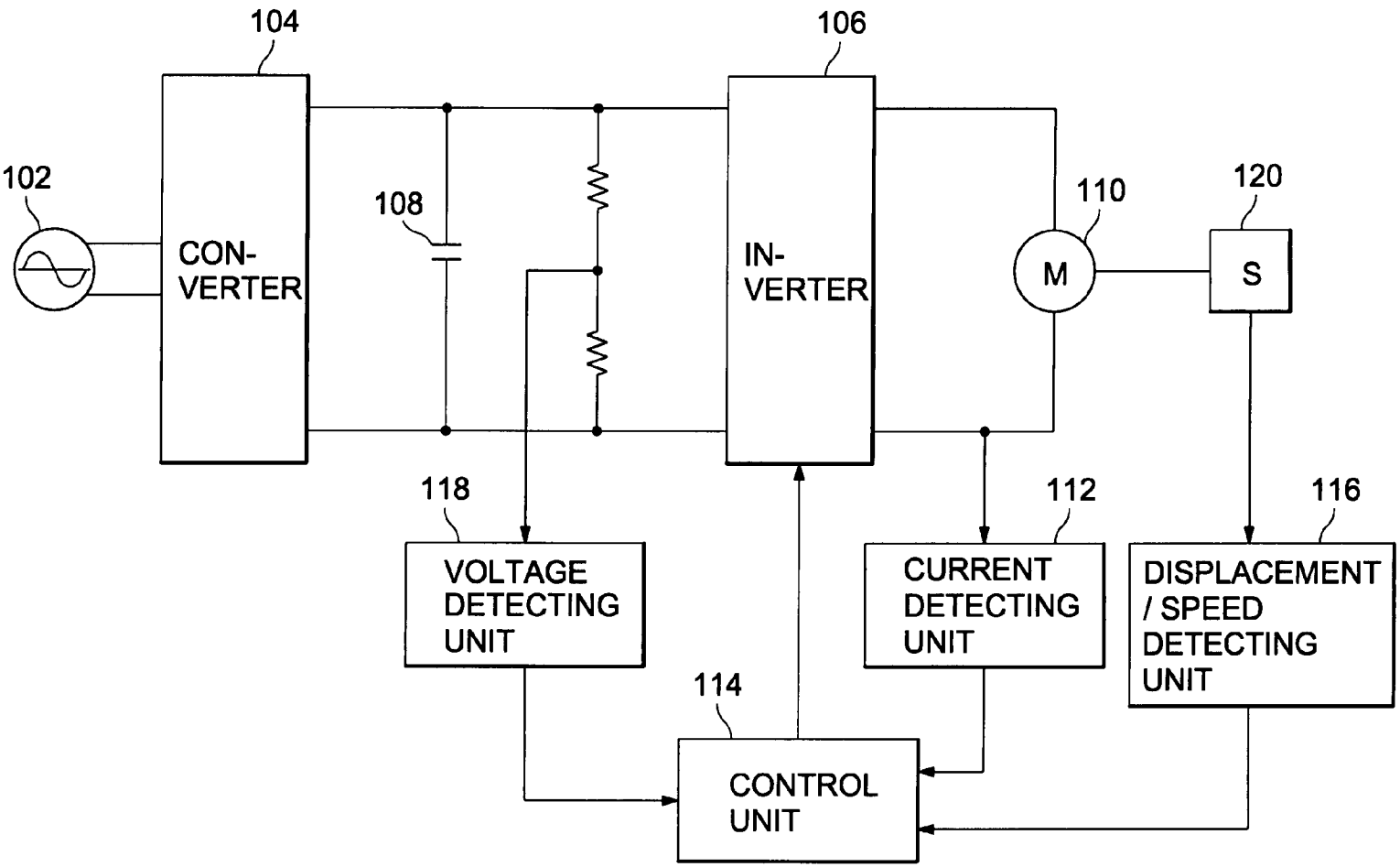
FIG. 1 is a block diagram of an apparatus to control a linear compressor, according to a first embodiment of the present invention.

Reference will now be made in detail to the present preferred embodiments of the present invention, examples of which are illustrated in the accompanying drawings, wherein like reference numerals refer to like elements throughout. The embodiments are described below to explain the present invention by referring to the figures.

FIGS. 1 to 4 are views showing a linear compressor and apparatus to control the linear compressor, according to a first embodiment of the present invention, which illustrates a case in which a displacement and a speed of a piston are detected through a displacement sensor, and a mechanical resonance frequency of the linear compressor is obtained using the detected displacement and the detected speed.

FIG. 1 is a block diagram of an apparatus controlling a linear compressor, according to the first embodiment of the present invention. As shown in FIG. 1, a converter 104 converts alternating current (AC) power supplied from an AC power source 102 into direct current (DC) power. An inverter 106 connected to the converter 104 through a DC coupling capacitor 108 generates AC power with a variable voltage level and/or a variable frequency required to drive a linear motor 110.

An input terminal and an output terminal of the inverter 106 are connected to a voltage detecting unit 118 and a current detecting unit 112, respectively. The voltage detecting unit 118 detects a level of a DC voltage supplied to the inverter 106. The current detecting unit 112 detects a drive current flowing through the linear motor 110.

A displacement/speed of the piston is obtained by a displacement sensor 120 and a displacement/speed detecting unit 116. The displacement sensor 120 detects a displacement of a mover (or piston) of the linear motor 110. The displacement/speed detecting unit 116 detects a displacement waveform and a movement speed waveform of a reciprocating piston based on results detected by the displacement sensor 120.

A control unit 114 controls a switching operation of the inverter 106 to allow the drive current supplied to the linear motor 110 to synchronize with a resonance frequency of the linear compressor using the results detected by the current detecting unit 112, the voltage detecting unit 118 and the displacement/speed detecting unit 116.

Figure 2:
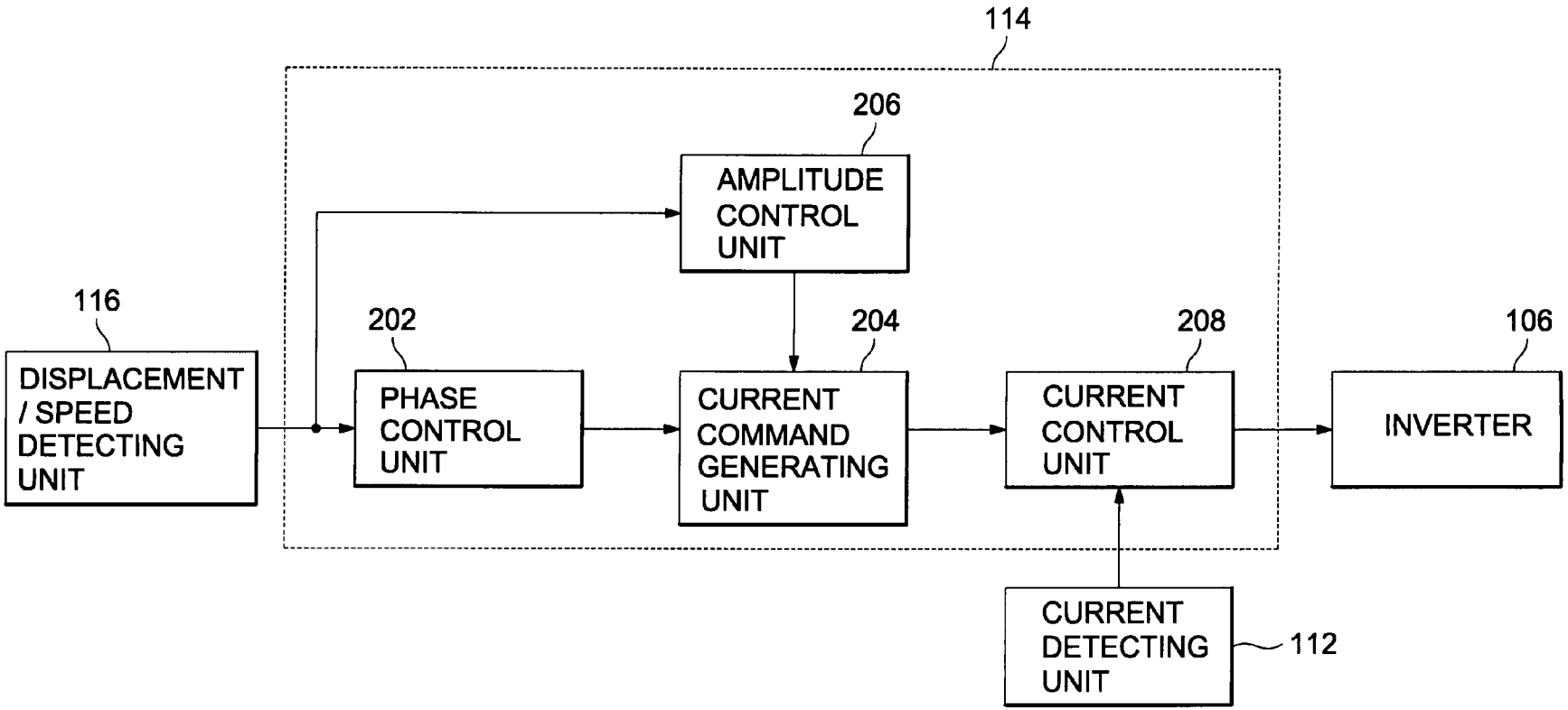
FIG. 2 is a block diagram showing a control unit of the linear compressor control apparatus of FIG. 1.

FIG. 2 is a block diagram showing the control unit 114 of the linear compressor control apparatus of FIG. 1. As shown in FIG. 2, the control unit 114 includes a phase control unit 202, an amplitude control unit 206, a current command generating unit 204 and a current control unit 208. The control unit 114 controls the inverter 106 so that the inverter 106 generates a reference current, which has a frequency and a phase equal to a resonance frequency and a phase of the piston and enables top and bottom dead centers of the piston to reach target values received from an outside of the linear compressor, and allows the drive current supplied to the linear motor 110 to synchronize with the reference current.

In FIG. 2, the phase control unit 202 generates a sine wave signal that has a phase equal to that of the movement speed waveform of the piston generated by the displacement/speed detecting unit 116 and has a phase difference of 90° compared to the displacement waveform. The amplitude control unit 206 obtains a first difference between an actual top dead center of the piston detected by the displacement/speed detecting unit 116 and a commanded top dead center based on the top dead center command received from the outside of the linear compressor and a second difference between an actual bottom dead center of the piston detected by the displacement/speed detecting unit 116 and a commanded bottom dead center based on the bottom dead center command received from the outside of the linear compressor. Further, the amplitude control unit 206 sets a maximum amplitude (peak value) of the drive current supplied to the linear motor 110 to an intensity to compensate for the first and second differences. The current command generating unit 204 generates a current command signal (a reference current) having frequency information of the sine wave signal output from the phase control unit 202 and information of the maximum amplitude output from the amplitude control unit 206. While monitoring a drive current currently supplied to the linear motor 110 and detected by the current detecting unit 112, the current control unit 208 generates an inverter control signal to control the inverter 106 so that the drive current supplied to the linear motor 110 is synchronized with the frequency, the phase and the maximum amplitude of the current command signal generated by the current command generating unit 204.

Figure 3:
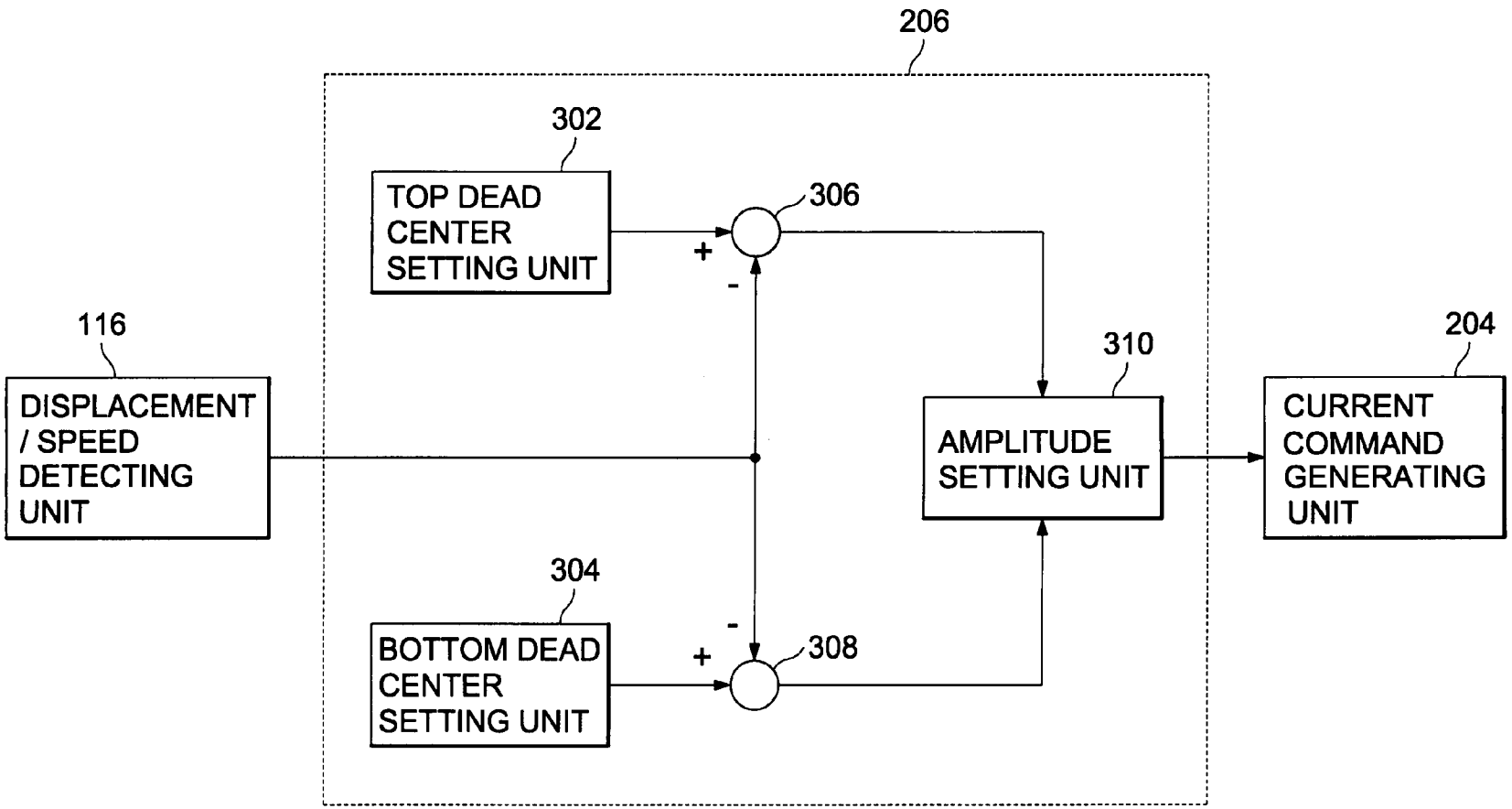
FIG. 3 is a block diagram showing an amplitude control unit of the control unit of FIG. 2.

FIG. 3 is a block diagram showing the amplitude control unit 206 of the control unit 114 of FIG. 2. As shown in FIG. 3, the top dead center command and the bottom dead center command, received from the outside of the linear compressor, are set in a top dead center setting unit 302 and a bottom dead center setting unit 304, respectively. A first adder 306 obtains a difference between the commanded top dead center set in the top dead center setting unit 302 and an actual top dead center of the piston detected by the displacement/speed detecting unit 116. A second adder 308 obtains a difference between the commanded bottom dead center set in the bottom dead center setting unit 304 and an actual bottom dead center of the piston detected by the displacement/speed detecting unit 116. An amplitude setting unit 310 sets the maximum amplitude of the sine wave signal to compensate for the differences between the commanded top dead center and the actual top dead center and between the commanded bottom dead center and the actual bottom dead center, which are obtained by the first and second adders 306 and 308, respectively. The maximum amplitude set by the amplitude setting unit 310 is provided to the current command generating unit 204, and later used as maximum amplitude information of the current command signal that controls the drive current supplied to the linear motor 110.

Figure 4:
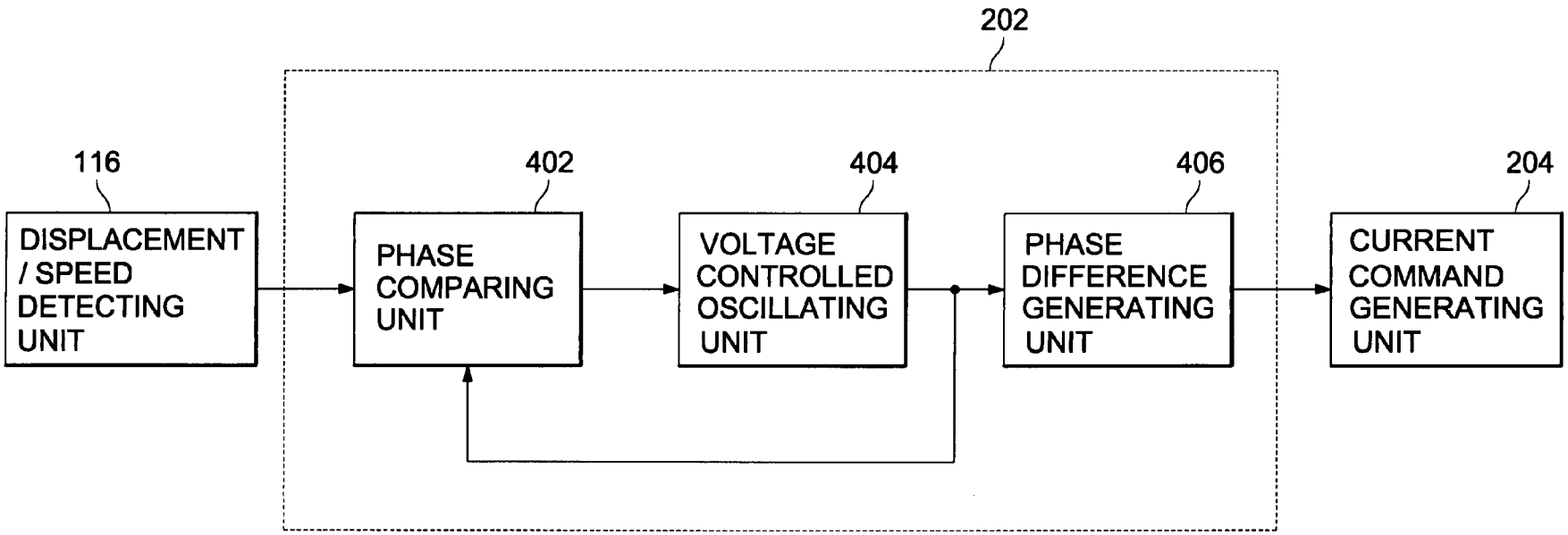
FIG. 4 is a block diagram showing a phase control unit of the control unit of FIG. 2.

FIG. 4 is a block diagram showing the phase control unit 202 of the control unit 114 of FIG. 2. As shown in FIG. 4, a phase comparing unit 402 compares phases of signals, respectively, output from the displacement/speed detecting unit 116 and a voltage controlled oscillating unit 404 with each other, and generates a voltage signal with an intensity (i.e., a magnitude) proportional to a phase difference therebetween. The voltage controlled oscillating unit 404 outputs a sine wave signal with a frequency varying in proportion to the intensity of the voltage signal output from the phase comparing unit 402. A phase difference generating unit 406 shifts a phase of the sine wave signal output from the voltage controlled oscillating unit 404 by 90°. The drive current must have a phase difference of 90° compared to the displacement waveform of the piston, or have a phase equal to that of the movement speed waveform of the piston. Therefore, the phase of the displacement waveform of the piston detected through the displacement sensor 120 is shifted by 90° by the phase difference generating unit 406 to be equal to that of the movement speed waveform. The sine wave signal generated by the phase control unit 202 is provided to the current command generating unit 204 and used as frequency and phase information of the current command signal.

That is, the current command generating unit 204 of the control unit 114 determines the frequency, the phase and the maximum amplitude of the current command signal by obtaining information of the phase and the maximum amplitude through the phase control unit 202 and amplitude control unit 206, thus generating the current command signal. The current control unit 208 generates an inverter control signal to control a switching operation of the inverter 106 so that the drive current supplied to the linear motor 110 is synchronized with the phase, the frequency and the maximum amplitude of the current command signal generated by the current command generating unit 204.

Figure 5:
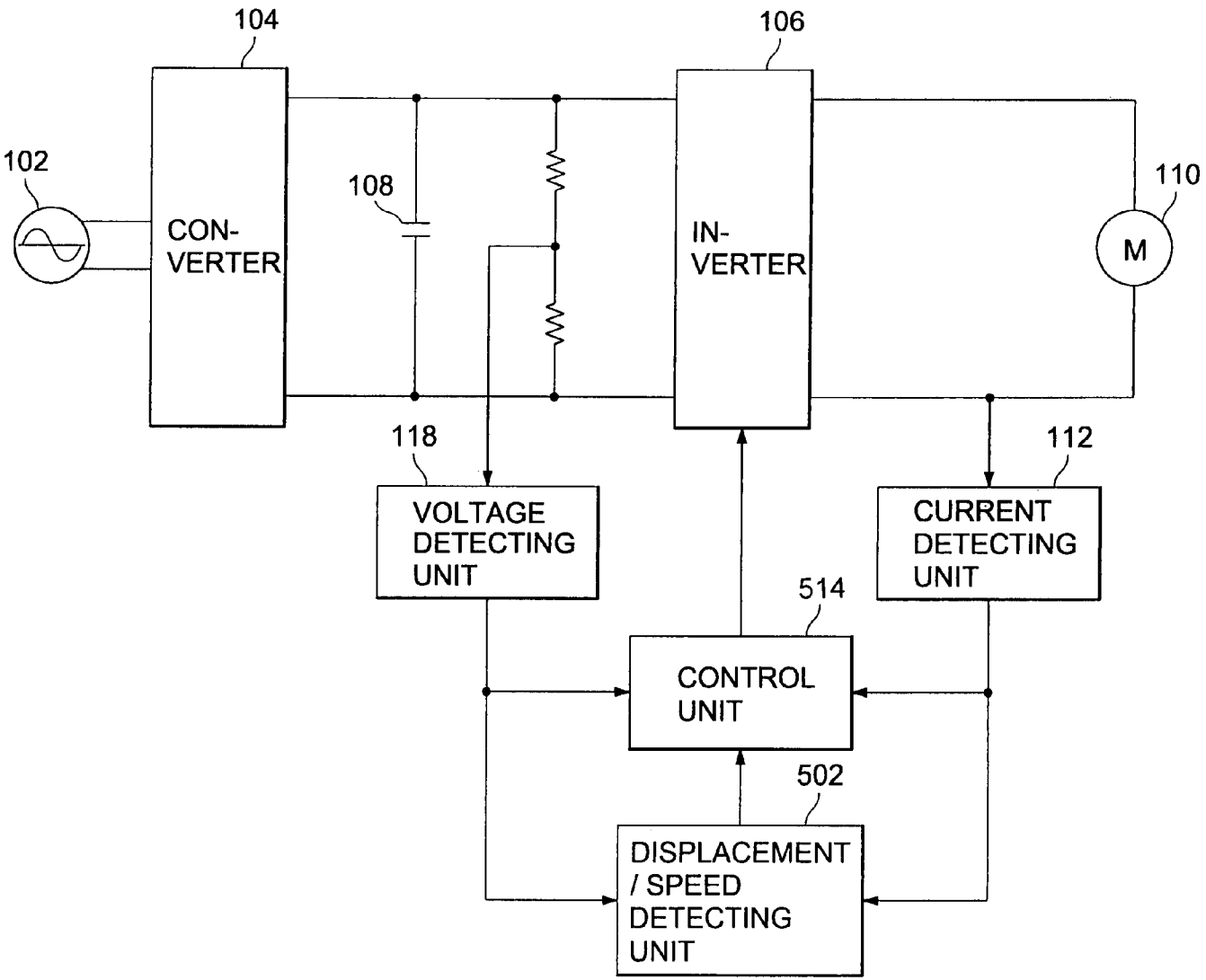
FIG. 5 is a block diagram of an apparatus to control a linear compressor, according to a second embodiment of the present invention.
Figure 6:
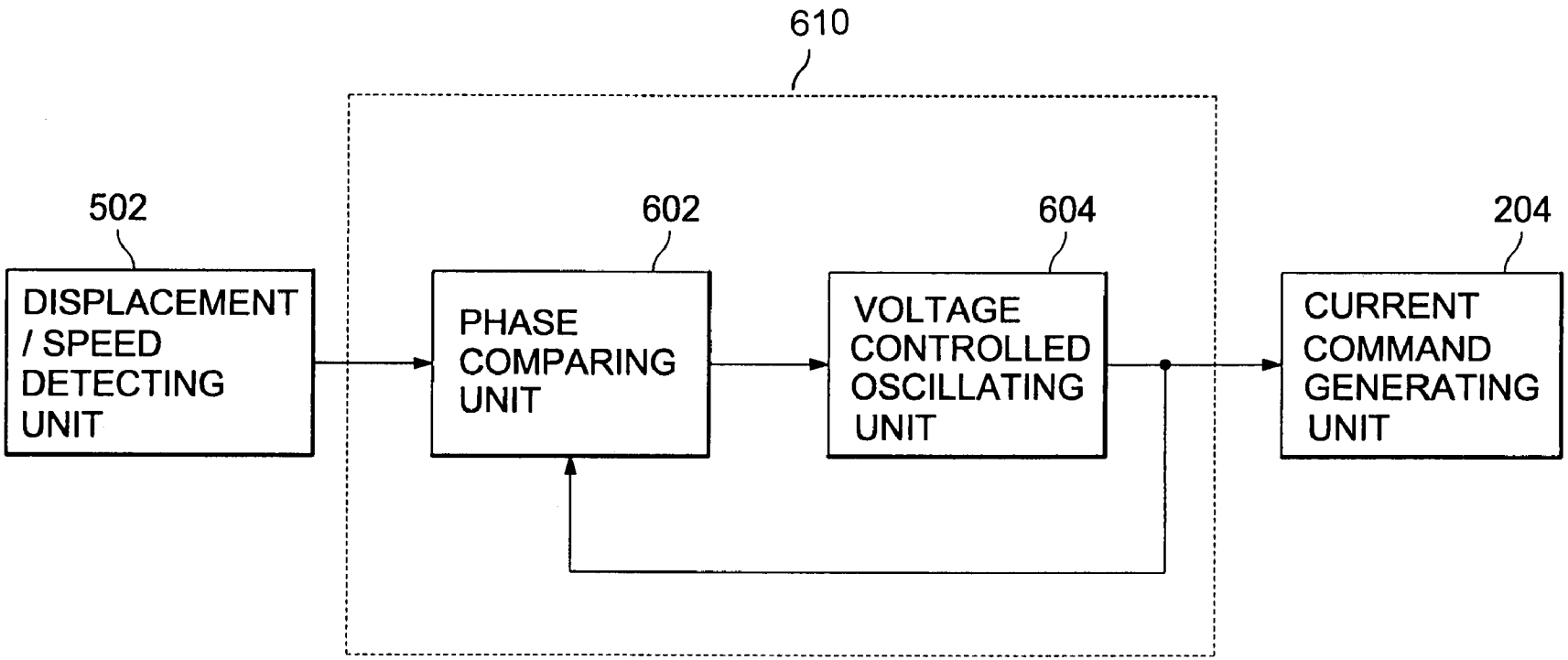
FIG. 6 is a block diagram showing a phase control unit provided in the linear compressor control apparatus of FIG. 5.

FIGS. 5 and 6 are views showing an apparatus controlling a linear compressor, according to a second embodiment of the present invention, which illustrates a case in which a displacement and a speed of a mover of a drive motor (linear motor) are indirectly detected using electrical characteristic values of the linear motor instead of using a displacement sensor, and a mechanical resonance frequency of the linear compressor is obtained using the indirectly detected displacement and the speed.

FIG. 5 is a block diagram of an apparatus controlling a linear compressor, according to a second embodiment of the present invention. As shown in FIG. 5, a displacement/speed detecting unit 502 generates displacement/speed waveforms of a piston using a drive current detected by a current detecting unit 112, a DC voltage supplied to an inverter 106 and detected by a voltage detecting unit 118, and electrical characteristic values of a linear motor 110. As is described above, a control unit 514 controls the drive current supplied to the linear motor 110 using the displacement/speed waveforms of the piston detected by the displacement/speed detecting unit 502.

In the control apparatus of FIG. 5, since the speed waveform of the piston is generated using the electrical characteristic values of the linear motor 110 instead of using a displacement sensor, a construction of a phase control unit 610 includable in the control unit 514 varies from the phase control unit 202 of the first embodiment of the present invention and is shown in FIG. 6. FIG. 6 is a block diagram showing a phase control unit 610 provided in the linear compressor control apparatus of FIG. 5. As shown in FIG. 6, since a speed waveform of the piston is directly detected using the electrical characteristic values of the linear motor 110, the phase control unit 610 does not require a phase difference generating unit 406 of the first embodiment of the present invention as shown in FIG. 4.

As is apparent from the above description, a linear compressor and an apparatus controlling the linear compressor are provided, which allow a frequency of a drive current supplied to a drive motor to synchronize with a resonance frequency varying according to a load fluctuation, in real time, thus obtaining a maximum efficiency of the linear compressor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A linear compressor, comprising:

a drive motor;

a piston reciprocating by the drive motor; and a control unit to generate a reference current having a phase difference of 90° and an equal frequency with respect to a displacement waveform of the piston, and to control a drive current supplied to the drive motor to synchronize with a resonance frequency of the piston by synchronizing the drive current with the reference current, wherein the control unit receives top and bottom dead center commands from an outside of the linear compressor, and sets a maximum amplitude of the reference current so that the drive current is synchronized with the reference current to allow top and bottom dead centers of the piston to satisfy the top and bottom dead center commands, respectively, and wherein the control unit compensates for differences between the commanded top dead center and an actual top dead center of the piston and between the commanded bottom dead center and an actual bottom dead center of the piston.

2. A linear compressor, comprising:

a drive motor;

a piston reciprocating by the drive motor; and a control unit to generate a reference current having both a phase thereof and a frequency thereof equal to a phase and a frequency of a speed waveform of the piston, and to control a drive current supplied to the drive motor to synchronize with a resonance frequency of the piston by synchronizing the drive current with the reference currents, wherein the control unit receives top and bottom dead center commands from an outside of the linear compressor, and sets a maximum amplitude of the reference current so that the drive current is synchronized with the reference current to allow top and bottom dead centers of the piston to satisfy the top and bottom dead center commands, respectively, and wherein the control unit compensates for differences between the commanded top dead center and an actual top dead center of the piston and between the commanded bottom dead center and an actual bottom dead center of the piston.

3. A linear compressor, comprising:

a drive motor;

a piston reciprocating by the drive motor;

a displacement sensor to detect a displacement of the piston;

a displacement/speed detecting unit to generate at least one of a displacement waveform and a speed waveform of the piston based on a value detected by the displacement sensor; and a control unit to generate a reference current satisfying a condition in which the reference current has a phase difference of 90° and an frequency equal to the displacement waveform of the piston, or a condition in which the reference current has a phase and a frequency thereof equal to a phase and a frequency of the speed waveform of the piston, and to control a drive current supplied to the drive motor to synchronize with a resonance frequency of the piston by synchronizing the drive current with the reference current, wherein the control unit receives top and bottom dead center commands from an outside of the linear compressor, and sets a maximum amplitude of the reference current so that the drive current is synchronized with the reference current to allow top and bottom dead centers of the piston to satisfy the top and bottom dead center commands, respectively, and wherein the control unit compensates for differences between the commanded top dead center and an actual top dead center of the piston and between the commanded bottom dead center and an actual bottom dead center of the piston.

4. A linear compressor, comprising:

a drive motor;

a piston reciprocating by the drive motor;

a displacement/speed detecting unit to detect a displacement of the piston using electrical characteristic values of the drive motor, and to generate at least one of a displacement waveform and a speed waveform of the piston based on the detected displacement; and a control unit to generate a reference current having a phase thereof and a frequency thereof equal to a phase and a frequency of a speed waveform of the piston, and to control a drive current supplied to the drive motor to synchronize with a resonance frequency of the piston by synchronizing the drive current with the reference current, wherein the electrical characteristic values of the drive motor include resistance information, inductance information, and back electromotive force constant information of the drive motor.

5. The linear compressor according to claim 4, wherein the displacement/speed detecting unit to detect a displacement of the piston uses a drive voltage and a drive current which are supplied to the drive motor in addition to the electrical characteristic values of the drive motor.

6. An apparatus to control a linear compressor having a drive motor and a piston reciprocating by the drive motor, the apparatus comprising:

a displacement/speed detecting unit to generate at least one of a displacement waveform and a speed waveform of the piston;

an amplitude control unit to set a maximum amplitude of a drive current required to control the drive motor so that top and bottom dead centers of the piston, respectively, satisfy top and bottom dead center commands received from an outside of the linear compressor;

a phase control unit to generate a reference waveform satisfying a condition in which the reference waveform has a phase difference of 90° with respect to the displacement waveform of the piston and a frequency equal to the displacement waveform of the piston, or a condition in which the reference waveform has both a phase thereof and a frequency thereof equal to a phase and a frequency of the speed waveform of the piston; and a current control unit to generate a reference current according to amplitude information and phase and frequency information provided from the amplitude control unit and the phase control unit, respectively, and to control the drive current supplied to the drive motor to synchronize with the reference current, and wherein the control unit compensates for differences between the commanded top dead center and an actual top dead center of the piston and between the commanded bottom dead center and an actual bottom dead center of the piston.

7. The linear compressor control apparatus according to claim 6, further comprising a displacement sensor to detect a displacement of the piston, the displacement/speed detecting unit generating at least one of the displacement waveform and the speed waveform of the piston based on the displacement of the piston detected through the displacement sensor.

8. An apparatus to control a linear compressor having a drive motor and a piston reciprocating by the drive motor, the apparatus comprising:

a converter to convert alternating current power into direct current power;

an inverter to generate alternating current power with a variable voltage and a variable frequency required to drive the drive motor;

a current detecting unit to detect a drive current supplied to the drive motor;

a voltage detecting unit to detect a supply voltage supplied to the drive motor;

a displacement sensor to detect a displacement of the piston;

a displacement/speed detecting unit to generate at least one of a displacement waveform and a speed waveform of the piston based on the displacement detected through the displacement sensor;

an amplitude control unit to set a maximum amplitude of a drive current required to Control the drive motor so that top and bottom dead centers of the piston, respectively, satisfy top and bottom dead center commands received from an outside of the linear compressor;

a phase control unit to generate a reference waveform satisfying a condition in which the reference waveform has a phase difference of 90° and a frequency equal to the displacement waveform of the piston with respect to the displacement waveform of the piston, or a condition in which the reference waveform has both a phase thereof and a frequency thereof equal to a phase and a frequency of the speed waveform of the piston; and a current command generating unit to generate a current command signal having frequency information and phase information of the reference waveform generated by the phase control unit, and maximum amplitude information generated by the amplitude control unit; and a current control unit to control a switching operation of the inverter to allow the drive current to synchronize with the frequency, phase and maximum amplitude information of the current command signal while monitoring the drive current detected through the current detecting unit and supplied to the drive motors, wherein the amplitude control unit comprises:

a first adder to obtain a difference between a commanded top dead center based on the top dead center command received from the outside of the linear compressor and an actual top dead center of the piston;

a second adder to obtain a difference between a commanded bottom dead center based on the bottom dead center command received from the outside of the linear compressor and an actual bottom dead center of the piston; and an amplitude setting unit to set the maximum amplitude of the drive current supplied to the drive motor to an intensity to compensate for the differences between the commanded top dead center and the actual top dead center and between the commanded bottom dead center and the actual bottom dead center, obtained by the first and second adders, respectively.

9. The linear compressor control apparatus according to claim 8, wherein the phase control unit comprises:

a voltage controlled oscillating unit;

a phase comparing unit to compare phases of signals, respectively, output from the displacement/speed detecting unit and the voltage controlled oscillating unit with each other, and to generate a voltage signal with an intensity proportional to a phase difference therebetween, the voltage controlled oscillating unit outputting a sine wave signal with a frequency varying in proportion to an intensity of the voltage signal output from the phase comparing unit; and a phase difference generating unit shifts a phase of the sine wave signal output from the voltage controlled oscillating unit by 90° such that the drive current has a phase difference of 90° compared to the displacement waveform of the piston, or has a phase equal to that of the speed waveform of the piston.

10. A linear compressor with a fluctuating load thereon, comprising:

a drive motor;

a piston reciprocating by the drive motor;

a displacement/speed detecting unit to detect a displacement of the piston using electrical characteristic values of the drive motor; and a control unit to synchronize a frequency of a drive current supplied to a drive motor with a reference current having a resonance frequency thereof varying according to a load fluctuation, wherein the synchronization is performed based on the electrical characteristic values, and wherein the electrical characteristic values of the drive motor include resistance information, inductance information, and back electromotive force constant information of the drive motor.

11. The linear compressor according to claim 1, further comprising:

a displacement sensor to detect a displacement of the piston; and a displacement/speed detecting unit to generate one or both of a displacement waveform and a speed waveform of the piston according to the detected displacement of the piston and supplying the displacement and/or speed waveforms to the control unit.

12. The linear compressor according to claim 1, further comprising:

a displacement/speed detecting unit to detect a displacement of the piston using electrical characteristic values of the drive motor, and to generate one or both of a displacement waveform and a speed waveform of the piston according to the detected displacement and supplying the displacement and/or speed waveforms to the control unit.

13. The linear compressor according to claim 12, wherein the displacement/speed detecting unit to detect a displacement of the piston uses a drive voltage and a drive current which are supplied to the drive motor in addition to the electrical characteristic values of the drive motor.

14. A linear compressor comprising:

a drive motor;

a piston reciprocating by the drive motor;

a control unit to generate a reference current having a phase difference of 90° and an equal frequency with respect to a displacement waveform of the piston, and to control a drive current supplied to the drive motor to synchronize with a resonance frequency of the piston by synchronizing the drive current with the reference current, and a displacement/speed detecting unit to detect a displacement of the piston using electrical characteristic values of the drive motor, and to generate one or both of a displacement waveform and a speed waveform of the piston according to the detected displacement and supplying the displacement and/or speed waveforms to the control unit, wherein the control unit receives too and bottom dead center commands from an outside of the linear compressor, and sets a maximum amplitude of the reference current so that the drive current is synchronized with the reference current to allow top and bottom dead centers of the piston to satisfy the top and bottom dead center commands, respectively, and wherein the electrical characteristic values of the drive motor include resistance information, inductance information, and back electromotive force constant information of the drive motor.

15. The linear compressor control apparatus according to claim 8, wherein the phase control unit comprises:

a voltage controlled oscillating unit; and a phase comparing unit to compare phases of signals, respectively, output from the displacement/speed detecting unit and the voltage controlled oscillating unit with each other, and to generate a voltage signal with an intensity proportional to a phase difference therebetween, the voltage controlled oscillating unit outputting a sine wave signal with a frequency varying in proportion to an intensity of the voltage signal output from the phase comparing unit.

* * * * *

UNITED STATES PATENT AND TRADEMARK OFFICE

CERTIFICATE OF CORRECTION

PATENT NO. : 7,439,692 B2
APPLICATION NO. : 10/790700
DATED : October 21, 2008
INVENTOR(S) : Kwang Woon Lee It is certified that error appears in the above-identified patent and that said Letters Patent is hereby corrected as shown below:

Column 6, Lines 16-17, change “currents,” to --current,--.

Column 8, Line 8, change “Control” to --control--.

Column 8, Line 30, change “motors,” to --motor,--.

Column 10, Line 17, change “too” to --top--.

Signed and Sealed this

Third Day of February, 2009

John Doll

JOHN DOLL
*Acting Director of the United States Patent and Trademark Office*